US005368445A

United States Patent [19]

Litvin et al.

[11] Patent Number: 5,368,445

[45] Date of Patent: Nov. 29, 1994

[54] PEDESTAL FAN

[75] Inventors: Charles Litvin, West Chester, Pa.; Kurt F. Haffken, Newark, Del.

[73] Assignee: Lasko Metal Products, Inc., West Chester, Pa.

[21] Appl. No.: 145,174

[22] Filed: Nov. 3, 1993

[51] Int. Cl.[5] ..... F04D 29/64

[52] U.S. Cl. ..... 416;246; 416/244 R; 403/298; 403/343; 403/367; 403/368; 248/159

[58] Field of Search ..... 416/244 R, 246, 247 R; 248/159, 910; 403/264, 343, 367, 368, 298

[56] References Cited

U.S. PATENT DOCUMENTS

| | | | |
|---|---|---|---|
| 2,830,779 | 4/1958 | Wentling | 416/244 R |
| 2,954,198 | 9/1960 | Lindberg et al. | 416/246 |
| 3,759,623 | 9/1973 | Hesse | 248/159 |
| 4,746,273 | 5/1988 | Sun | 416/246 |

FOREIGN PATENT DOCUMENTS

| | | | |
|---|---|---|---|
| 464554 | 4/1950 | Canada | 416/246 |
| 251490 | 3/1911 | Germany | 416/244 R |
| 640728 | 6/1962 | Italy | 416/247 R |
| 261698 | 11/1987 | Japan | 416/246 |
| 2023730 | 1/1980 | United Kingdom | 416/247 R |

*Primary Examiner*—Edward K. Look
*Assistant Examiner*—James A. Larson
*Attorney, Agent, or Firm*—Zachary T. Wobensmith, III

[57] ABSTRACT

A pedestal fan which is lightweight, is readily capable of disassembly for shipping, storing and use which includes a base with optional weight, a two-piece tubing member one piece of which is detachably retained in the base, the pieces retained together by a connector, and with the other tubing piece detachably retained in a yoke which supports a fan outer housing which is tiltable for air direction variance, which housing contains a fan motor and blade and provides air flow. The tubing pieces are of different lengths which permits mounting the housing at different heights above the base for multi-height cooling needs.

8 Claims, 4 Drawing Sheets

PEDESTAL FAN

BACKGROUND OF THE INVENTION

Field of the Invention

This invention relates to a pedestal fan of the multi-height type.

DESCRIPTION OF THE PRIOR ART

Pedestal fans have long been known in the prior art. Such fans are useful when an elevated fan is desired which is portable and with adjustable air flow direction. The prior art fans are heavy, can easily tip over, are expensive, can not be readily assembled and disassembled and suffer from other disadvantages.

The pedestal fan of the invention can be readily assembled and disassembled for shipping, transport or use; is stable, lightweight, provides air flow at various convenient heights; and has other positive advantages.

SUMMARY OF THE INVENTION

In accordance with the invention a pedestal fan is provided which has multi-height air movement capability with a fan yoke which contains a blade and motor with the yoke mounted to a piece of tubing which is detachably retained to another piece of tubing of different length by a U-connector and detachably connected to a fan base with an optional weight carried by the base to enhance stability.

The principal object of the invention is to provide an improved pedestal fan that can provide air flow at different heights.

A further object of the invention is to provide a fan of the character aforesaid which can be readily assembled and dissassembled.

A further object of the invention is to provide a fan of the character aforesaid wherein two pieces of tubing of different length are used to connect the fan base and yoke with a connector joining the tubing pieces.

A further object of the invention is to provide a fan of the character aforesaid which has improved retention of the fan and yoke to the tubing which connects them.

A further object of the invention is to provide a fan of the character aforesaid which has improved resistance to tip-over.

A further object of the invention is to provide a fan of the character aforesaid which is portable, lightweight, long lasting and durable in service.

A further object of the invention to provide a fan of the character aforesaid wherein many of the major components are of molded plastic.

Other object and advantageous features of the invention will be apparent from the description and claims.

DESCRIPTION OF THE DRAWINGS

The nature and characteristic features of the invention will be more readily understood from the following description taken in connection with the accompanying drawings in which.

It should of course be understood that the description and drawings are merely illustrative and that various modifications and changes can be made in the structure disclosed without departing from the spirit of the invention.

Like numerals refer to like parts throughout the several views.

DESCRIPTION OF THE PREFERRED EMBODIMENT

Figure 1:
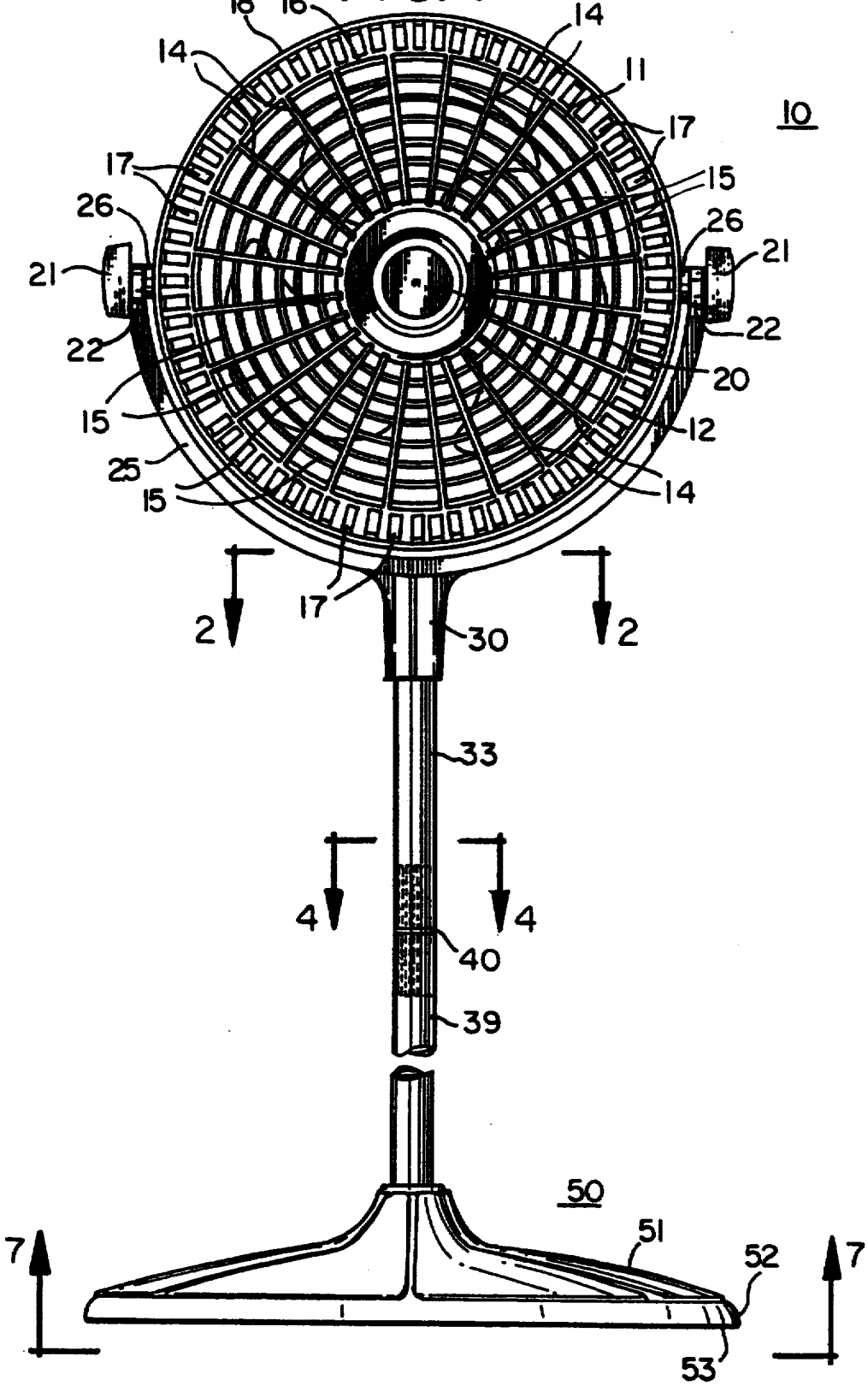
FIG. 1 is a front elevational view of the pedestal fan of the invention.

Referring now more particularly to FIG. 1 of the drawings the pedestal fan 10 is therein illustrated. The fan 10 includes an outer housing 11 of two piece circular configuration, with a face plate 12 which has a plurality of integral radial ribs 14 extending therefrom with a plurality of circular ribs 15 integral therewith and which ribs 14 extend to circumferential rib 16. A plurality of L-shaped ribs 17 are provided integral with rib 16 and which extend rearwardly to an outer rib 18 which is connected to a rear portion (not shown) of housing 11 to which a fan motor (not shown) is mounted which has a blade 20 mounted thereto. The motor (not shown) is connected in a well known manner to a source of electric power (not shown) by wires (not shown). The housing 11 at each side has a thumb-screw 21 engaged therewith which has a shaft (not shown) which extends through an opening (not shown) and is engaged with the ends 22 of a half circular yoke 25. Washers 26 are provided on the thumb-screws 21 between yoke ends 22 and housing 11, of a soft compressible plastic material which upon tightening of thumb-screws 21 restricts or locks the housing 11 in position for air direction as required.

Figure 2:
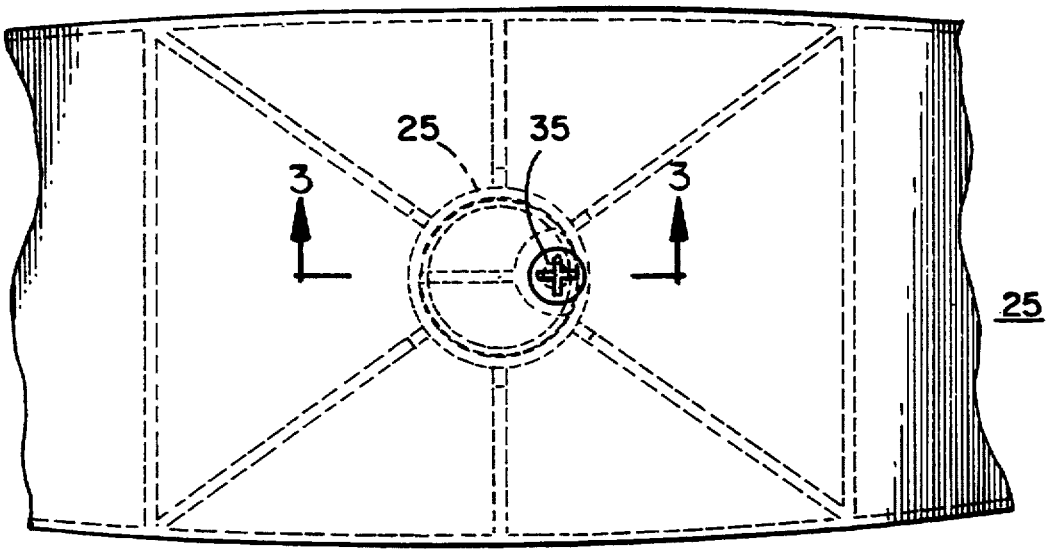
FIG. 2 is a horizontal sectional view enlarged taken approximately on the line 2—2 of FIG. 1.
Figure 3:
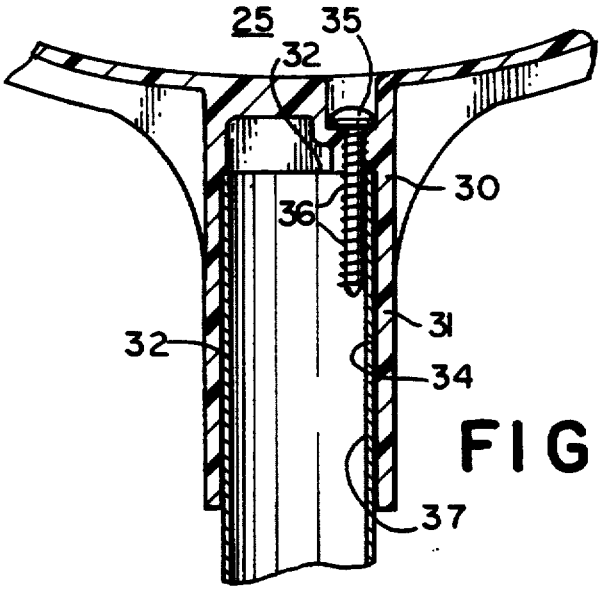
FIG. 3 is a vertical sectional, view enlarged taken approximately on the line 3—3 of FIG. 2.

As shown particularly in FIGS. 2 and 3 the yoke 25 has an integral extension 30 extending downwardly therefrom which includes a hollow outer cylindrical member 31 with a wall 34, and an abutment 32 therein and is shown with a piece of hollow metal tubing 33 which is engaged by the abutment 32. The abutment 32 has a screw 35 extending therethrough, which screw has threads 36 which engage the interior surface 37 of the tubing, and the tubing is held therein by friction between the wall 34 and screw 35 which retains the tubing 33 in frictional engagement with member 31 but permits removal as desired.

Figure 4:
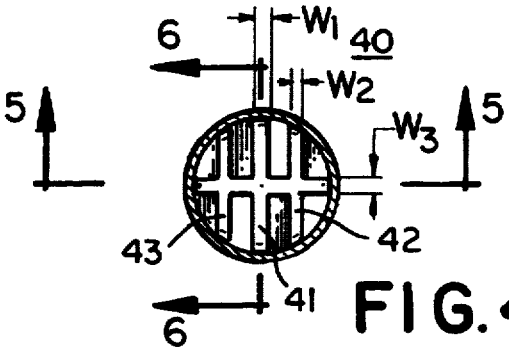
FIG. 4 is a horizontal sectional view, enlarged taken approximately on the line 4—4 of FIG. 1.
Figure 5:
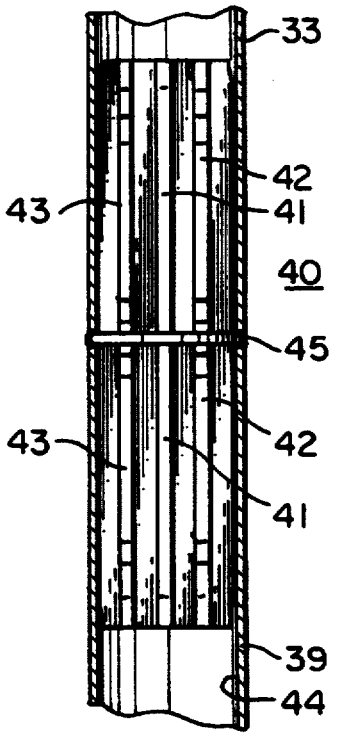
FIG. 5 is a vertical sectional view taken approximately on the line 5—5 of FIG. 4.
Figure 6:
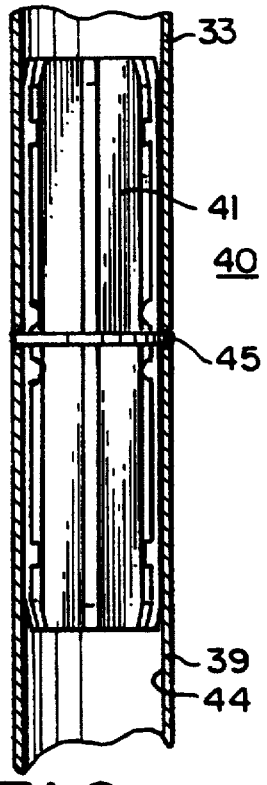
FIG. 6 is a vertical sectional view taken approximately on the line 6—6 of FIG. 4.

Referring additionally to FIGS. 4 to 6, the tubing 33 is connected to another piece of tubing 39 of different length, by a connector 40. The connector 40 is cylindrical with a plurality of longitudinal ribs 41, 42, and 43 of decreasing width across the diameter of the connector, which are frictional engagement with the interior surfaces 37 of tubing 33 and 44 of tubing 39. A ring 45 is provided which separates the ribs 40–43 and is of the same diameter as the tubing pieces 33 and 39.

Figure 7:
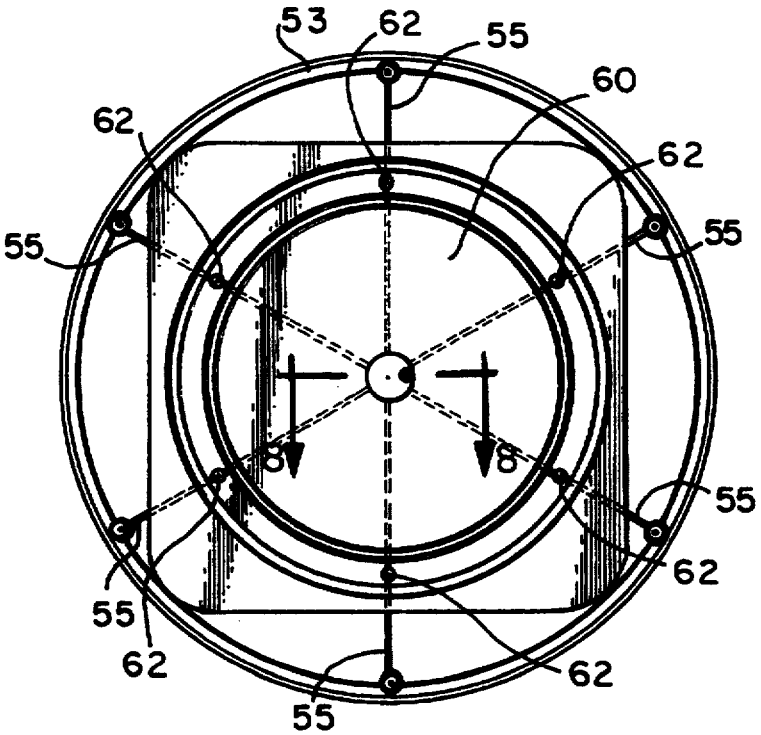
FIG. 7 is a horizontal sectional view of the fan base taken approximately on the line 7—7 of FIG. 1.
Figure 8:
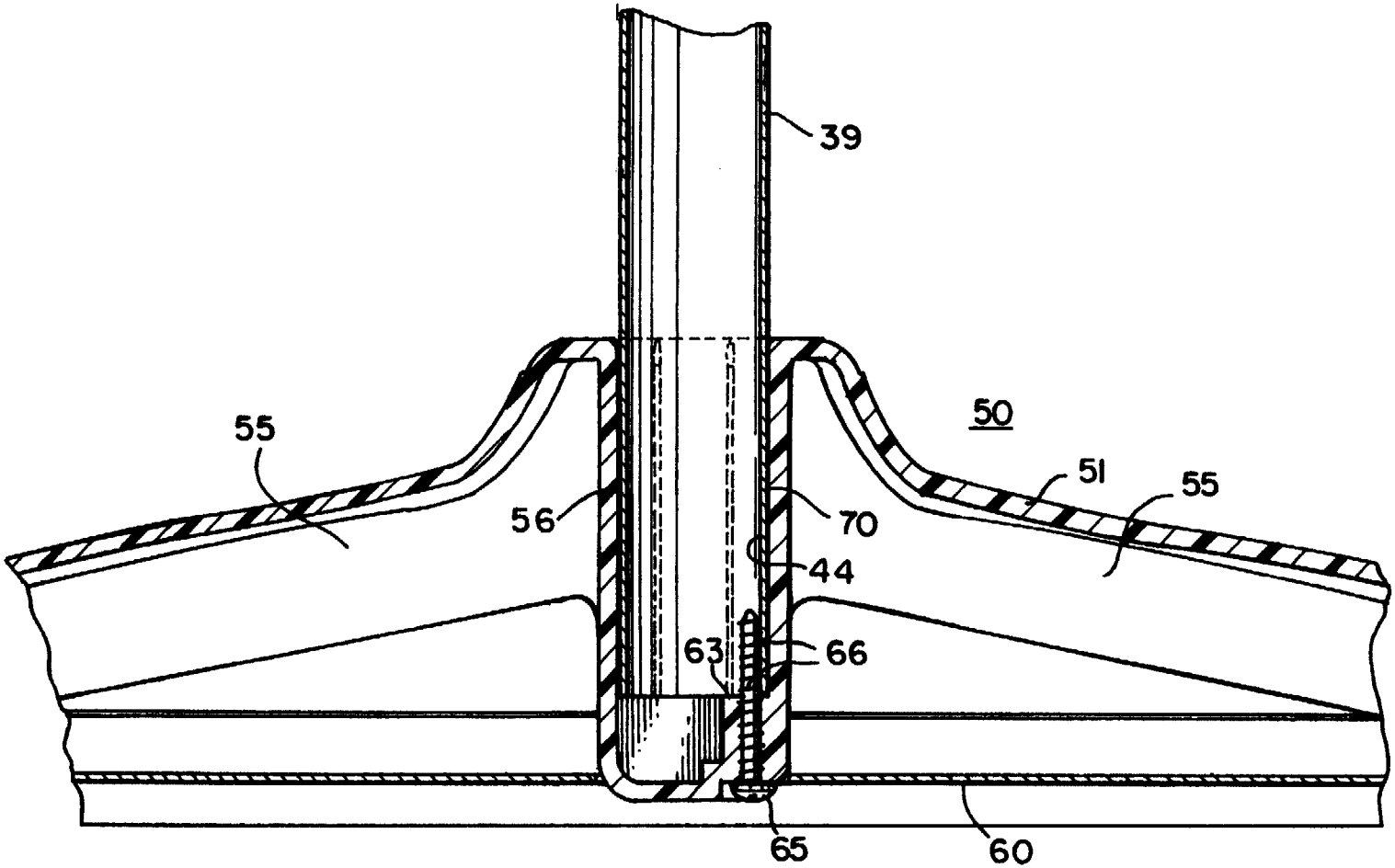
FIG. 8 is a vertical sectional view, enlarged taken approximately on the line 8—8 of FIG. 7.

Referring additionally to FIGS. 7 and 8 the fan base 50 is illustrated, which is of circular configuration with an outer wall 51 which slopes downwardly from the center to a circumferential outer ring 52 which has a bottom surface 53 which rests on the floor or other support surface (not shown).

The base 50 is hollow with a plurality of ribs 55 which engage a center hub 56 and extend out to and join the rim 52. A weight 60 is provided whose use is optional depending on the height of the fan housing and which helps it resist tip-over of the fan 10. The weight 60 is a steel plate of rectangular configuration, which fits onto the ribs 55, and is secured thereto by a plurality of screws 62 engaged in base 50. The hub 56 extends downwardly from the center of the outer wall 51 of hollow cylindrical configuration, with an outer wall 70 and an interior abutment 63, with the tubing piece 39 therein and against the abutment 63. A screw 65 is provided which extends through the abutment 63, and whose threads 66 engage the interior surface 44 of tubing piece 39 to frictionally retain it in hub 56. To engage the tubing piece with screw 65 it is pushed into hub 56 against abutment 63 and is retained therein by frictional engagement between the screw 65 and the wall 70 of hub 56. The tubing pieces 33 and 39 can be removed by rotation in a counterclockwise direction and withdrawn. One or both of the tubing pieces can be used to connect the base and yoke which provides three different fan heights.

The base 50, housing 11, and yoke 25 are preferably formed of any suitable lightweight synthetic plastic with polyethylene being particularly suitable.

It will thus be seen that a pedestal fan has been provided with which the objects of the invention are achieved.

We claim:

1. A pedestal fan which comprises base means, yoke means, a fan housing mounted to said yoke means which has a fan motor and blade therein, tubing means in detachable connecting relation with said base means and said yoke means;

wherein said tubing means is two pieces of hollow tubing and a connector detachably joining said pieces, and said connector is of cylindrical configuration with a plurality of longitudinal ribs of decreasing width which are in frictional engagement with said tubing pieces.

2. A pedestal fan as defined in claim 1 in which said base means is of circular configuration and provided with a weight.

3. A pedestal fan as defined in claim 1 in which said tubing pieces are of metal.

4. A pedestal fan as defined in claim 1 in which said pieces of tubing are of different lengths.

5. A pedestal fan as defined in claim 1 in which said yoke means has an integral cylindrical extension extending downwardly therefrom, said extension is hollow with an outer cylindrical wall and an abutment therein, said abutment has a screw engaged therewith and extending downwardly along said wall, one of said pieces of tubing engages said abutment and is frictionally retained in said extension between said screw and said wall.

6. A pedestal fan as defined in claim 1 in which said base means, said yoke means, and said housing are formed of molded plastic.

7. A pedestal fan as defined in claim 1 in which said base means includes a hollow cylindrical center hub an outer wall, said center hub has an abutment therein, a threaded screw is engaged in said abutment and extended upwardly along said wall and said screw engages one of said pieces of tubing, which tubing engages said abutment and is frictionally retained in said hub between said wall and said screw.

8. A pedestal fan as defined in claim 1 in which said yoke means is half-circular, said housing is mounted to said yoke means by thumb screws which extend through said yoke means into said housing to permit tilting of said housing with respect to said yoke means for air direction, and compressible washers are provided between said yoke means and said housing whereby upon tightening of said thumb-screw said washers are compressed, locking said housing into position.

* * * * *

UNITED STATES PATENT AND TRADEMARK OFFICE

CERTIFICATE OF CORRECTION

PATENT NO. : 5,368,445

DATED : November 29, 1994

INVENTOR(S) : Charles Litvin and Kurt F. Hafeken

It is certified that error appears in the above-identified patent and that said Letters Patent is hereby corrected as shown below:

Column 4, line 25,
CLAIM 7

Line 3, After "hub" insert -with-,

Column 4, claim 8, line 41,

Line 9, "screw should be "screws".

Signed and Sealed this

Fourteenth Day of March, 1995

*Attest:*

*Attesting Officer*

Bruce Lehman

BRUCE LEHMAN

*Commissioner of Patents and Trademarks*